US006691498B2

(12) United States Patent
Coffin

(10) Patent No.: US 6,691,498 B2
(45) Date of Patent: Feb. 17, 2004

(54) SADDLETREE INCORPORATING GRAPHITE LAYERS

(76) Inventor: Edmund Coffin, 1151 Dairy Rd., Ruckersville, VA (US) 22968

( * ) Notice: Subject to any disclaimer, the term of this patent is extended or adjusted under 35 U.S.C. 154(b) by 0 days.

(21) Appl. No.: 10/109,987

(22) Filed: Mar. 29, 2002

(65) Prior Publication Data

US 2002/0174631 A1 Nov. 28, 2002

Related U.S. Application Data

(60) Provisional application No. 60/280,464, filed on Mar. 30, 2001.

(51) Int. Cl.[7] ..... B68C 1/02
(52) U.S. Cl. ..... 54/44.7
(58) Field of Search ..... 54/44.7

(56) References Cited

U.S. PATENT DOCUMENTS 3,251,110 A * 5/1966 Hedu ..... 24/616
3,258,894 A 7/1966 Hoaglin
3,293,828 A 12/1966 Hessler
3,712,024 A 1/1973 Nankivell, Jr.
3,780,494 A 12/1973 Nankivell, Jr.
4,860,524 A * 8/1989 Dumoulin et al. ..... 54/44.7
5,101,614 A 4/1992 Bozanich
6,044,630 A * 4/2000 Coffin ..... 54/44.4

* cited by examiner

*Primary Examiner*—Charles T. Jordan
*Assistant Examiner*—Bret Hayes
(74) *Attorney, Agent, or Firm*—Parker & DeStefano, P.C.

(57) ABSTRACT

An equine saddletree has increased strength and minimal torquing due to the alternation of the multiple wood layers with layers of graphite. The interior graphite layers consist of at least one layer of woven graphite sheet material having a warp and fill and extending from the cantle to the pommel. The woven graphite sheet placement on the wood layer defines whether the wood layer is considered a parallel or an angled layer. The parallel and angled graphite layers are alternated to form the saddletree. Additionally, each of the graphite layers has at least one strip of graphite tape covering the pommel, approximately perpendicular to the sidebars. Strips of graphite tape extend diagonally, in alternating directions, along each length of both the first surface and the second surface to prevent torque. A second layer of graphite tape pommel strips is applied to both the first and second surfaces covering at least a portion of the pommel. A pocket-receiving tab is secured within a notch in opposing ends of the pommel and interacts with the tab-receiving pocket on the cushioning panels to position the cushioning panels.

12 Claims, 6 Drawing Sheets

Figure 7
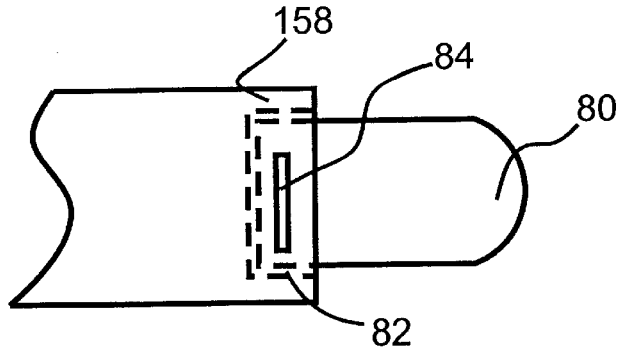
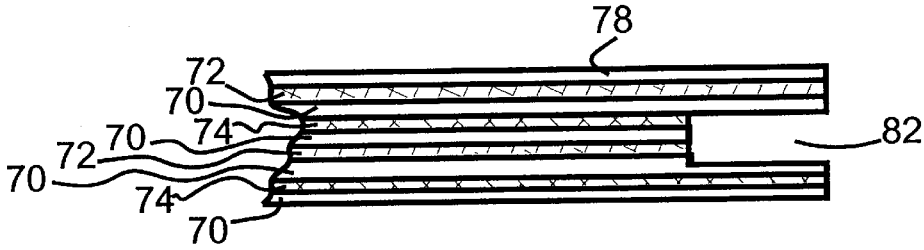
Figure 8
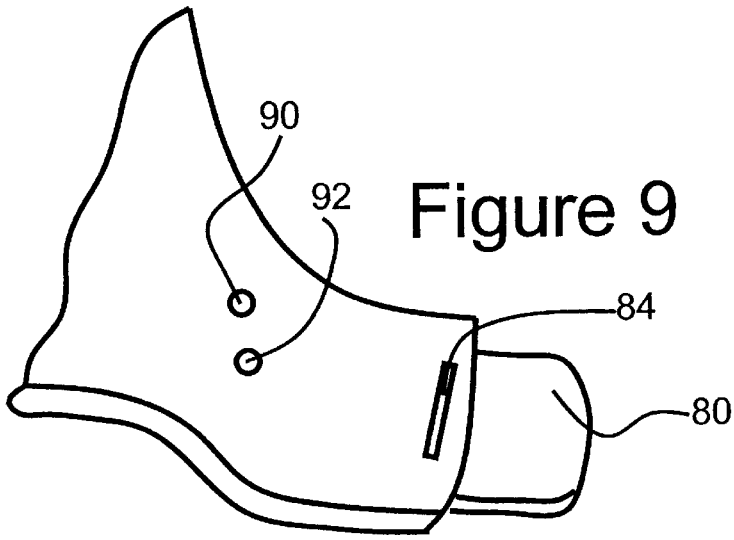
Figure 9

SADDLETREE INCORPORATING GRAPHITE LAYERS

This application claims the benefit of provisional application No. 60/280,464 filed Mar. 30, 2001

BACKGROUND OF THE INVENTION

1. Field of the Invention

This invention relates to an improved saddletree designed to add strength while reducing weight over the standard wood saddletree.

2. Brief Description of the Prior Art

Few changes have been made over the centuries that saddles have been in use. The English saddle tree has kept approximately the same shape and has been made primarily of wood for hundreds of years until after WWII. At that time sprint steel attachments were incorporated into the design to allow the tree more elasticity combined with flexibility. Until the recent use of plastics, and other manmade materials, little had been done to reduce weight. The latest major advancement in saddles trees was disclosed in U.S. Pat. No. 6,044,630, in which a saddle having improved balance and fit of a saddle is disclosed; the '630 patent being incorporated herein as though recited in full.

Strength, however, remained an issue. Saddles must provide some flexibility, however excessive torque has been a problem with prior art trees of wood construction. A professional quality saddle is an expensive investment and expected to last many years. A cracked, weakened or broken tree, however, immediately makes the saddle unusable. It would be easy to strengthen a saddle if weight wasn't also a concern.

In U.S. Pat. No. 5,101,614 a hollow saddletree formed of rotationally molded cross-linked polyethylene was disclosed. The hollow saddletree is of unitary, one piece construction and formed of cross-linked polyethylene by a rotational molding process with all of the structural elements of the saddle being of substantially equal thickness. Because the saddletree it is hollow, light and sufficiently flexible, it conforms to the contours of back of the horse.

Fiberglass reinforced plastics have also been used to reduce the cost of saddle manufacturing. Saddletrees of this nature are described in U.S. Pat. No. 3,293,828 to Hessler incorporated herein by reference. The problem with fiberglass-reinforced saddletrees is that they are too rigid and, under the stresses of usage, show a distinct tendency to break down. In addition, saddletrees formed of fiber reinforced plastics are too stiff and do not conform to the horse's back. In consequence, they cause abrasion to the sides of the horse, to the material discomfort of the horse. Saddles formed of foam-filled fiber reinforced plastics have also been described in U.S. Pat. No. 3,258,894 to Hoaglin. In this construction, two sections are molded from fiber reinforced plastic, combined together and the interior filled with urethane foam.

Injected molded saddles have also been tried and described in U.S. Pat. Nos. 3,712,024 and 3,780,494. High cost of molding, difficulty of quality control and lack of versatility have been the problems with injected molded saddles.

None of the foregoing prior art saddles, however, have been able to make a lightweight saddletree that provides fit and balance combined with flexibility without torque.

BRIEF DESCRIPTION OF THE DRAWINGS

The advantages of the instant disclosure will become more apparent when read with the specification and the drawings, wherein:

FIG. 7 is a top view of the attachment tab for the under panels;

FIG. 8 is a cutaway side view of the receiving notch within the saddletree for the attachment tab of FIG. 7; and FIG. 9 is a top view of the stirrup bar receiving holes within the saddletree.

SUMMARY OF THE INVENTION

Figure 2:
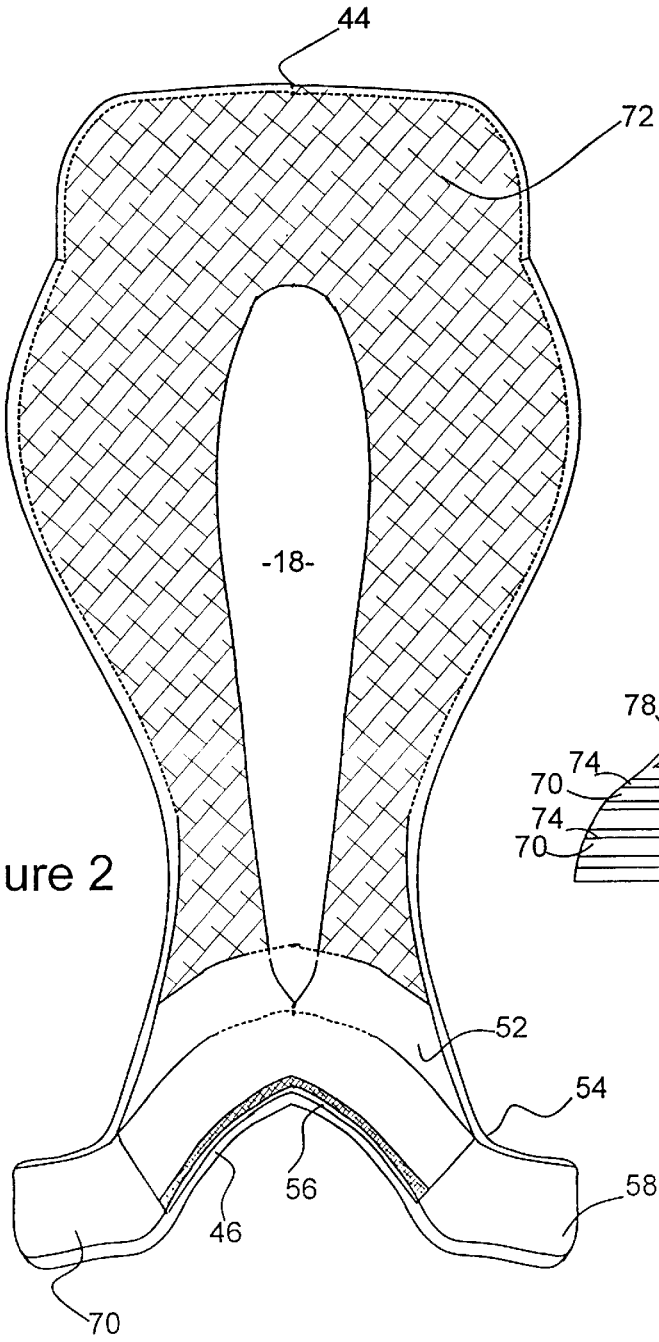
FIG. 2 is a top view of the disclosed saddletree showing interior layers of woven graphite at right angles to tree centerline and showing two strips of graphite tape across the pommel.

An equine saddletree is disclosed that has a first surface, a second surface, a cantle, a pommel, and a pair of sidebars extending between the cantle and pommel to form a length, leaving a center cutout section. The saddletree has increased strength and minimal torquing due to the alternation of the multiple wood layers with layers of graphite.

The interior graphite layers consist of at least one layer of woven graphite sheet material having a warp and fill and extending from the cantle to the pommel. The woven graphite sheet placement on the wood layer defines whether the wood layer is considered a parallel or an angled layer. Graphite layers having either the warp or fill approximately parallel to the length form a parallel layer while layers with has one of said warp or fill at approximately a 45-degree angle to said length forming the angled layer. The parallel and angled graphite layers are alternated to form the saddletree. Additionally, each of the graphite layers has at least one strip of unidirectional graphite tape covering the pommel, approximately perpendicular to the sidebars.

Strips of unidirectional graphite tape extend diagonally along each length of both the first surface and the second surface to prevent torque. A first strip tape is placed adjacent to the center cutout section proximate said cantle at a first end and adjacent an exterior edge proximate said pommel at a second end. A second strip of tape is applied adjacent to an exterior edge proximate the cantle at a first end and adjacent to the center cutout section proximate said pommel at a second end. A second layer of graphite tape pommel strips is also applied, on both the first and second surfaces covering at least a portion of the pommel, perpendicular to the length.

To secure the cushioning panels, a point tab is secured within a notch in opposing ends of the pommel points. The point tab interacts with a receiving pocket on the cushioning panels to position the cushioning panels adjacent to the second surface of said saddletree

DETAILED DESCRIPTION OF THE INVENTION

The traditional saddletree is comprised of thin layers of wood, with glue in between, that are molded into the desired form. Additionally, the life span of the glued wood trees with metal reinforcement is limited as eventually use stretches the width of the tree and increases the possibility of severe torquing. Prior art methods of compensating for the breakdown of the traditional tree has been to add metal reinforcements, which subsequently add weight. Many saddles eventually fail from the affects of constant and, at times, considerable torque.

In the disclosed saddletree the layers of laminated wood traditionally used for saddletrees are reinforced with layers of woven graphite and strips of graphite tape. To optimize the torque resistance taught herein, the graphite tape should be unidirectional, however, it is the torque resistance that is critical and multi-directional tape can be used if the desired criteria are met. Additionally, although reference herein is to graphite, an equivalent material can be used. In order to provide optimum strength, the woven graphite is turned to place the weave at alternating 90° or 45° angles to the centerline. This combination eliminates torque while providing the required flexibility.

The preferred unidirectional graphite tape for use herein has a width of about 1.0 inch, a weight of about 11 oz. and a thickness of about 0.0011 to 0.0015. The woven graphite is produced commercially as sheet material and preferably has approximately the same thickness as the graphite tape. The saddle is laminated using West Systems Epoxy Resins, or an equivalent that is compatible with both the wood and carbon. Lamination of unidirectional and woven graphite materials together with about 1.5 mm plywood in alternating layers provides optimum strength and stiffness while allowing a suitable substrate for the application of staples necessary to affix other saddle components to the tree.

The graphite tape is a critical factor in the elimination of distortion in the saddletree. The tape, once bonded with the resin, becomes inflexible and encases the saddle with sufficient strength to prevent distortion as well as end-to-end and side-to-side movement.

Figure 1:
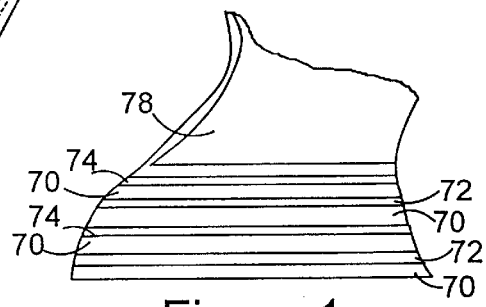
FIG. 1 is a cutaway, cross-sectional side view of the disclosed saddletree illustrating the alternating layers of wood and graphite in finished form.

The alternating wood layers 70 and horizontal woven graphite 72 and diagonal woven graphite 74 pattern is illustrated in FIG. 1. As can be seen, the alternating layers of horizontal woven graphite 72 and diagonal woven graphite 74 are placed between the wood layers 70, leaving the top wood layer 78 without either the woven graphite layer 72 or 74. The addition of woven graphite layers 72 or 74 on the exterior faces can, depending upon the thickness of the graphite and wood layers 70, make the tree excessively stiff. In order to move with the horse, there must be some flexibility to the tree. Preferably that flexibility is in the range of about at least 5% and less than 20% from pommel contact points when the tree is laid upon a horizontal surface. Additionally, the extra layers of woven graphite, especially around the periphery, interferes with the ability to staple, or otherwise secure, the subsequent layers to the tree. The woven graphite used herein preferably has a thickness in the range of 0.011 and 0.015, although this can be adjusted based upon size of saddle and intended end use and will be evident to those skilled in the art. The horizontal woven graphite 72 and diagonal woven graphite 74 does not address the torque issue, but rather the strength of the tree, eliminating unwanted side-to-side and end-to-end movement and providing a general stiffening that prevents breakage. Saddletrees are frequently placed under substantial pressure and, up until the disclosed saddletree, have been forced to use metal to reinforce the structure and counter the rider applied pressure. The woven structure of the graphite, once bonded with the wood and reinforced with the graphite tape, enables the removal of the standard metal reinforcements, thereby reducing the weight of the saddle.

The disclosed patent uses the inherent make up of the woven graphite's warp and fill maximize strength. To obtain the maximum strength benefit, it is preferred that the directional placement of the woven graphite 72, FIG. 2 and 74, FIG. 3, be alternated between the horizontal (90°) and the diagonal (45°) respectively in relationship to the centerline between the pommel 46 and cantle 44, thereby creating bracing in multiple directions. In this manner the strongest directions, those of the straight line of the fibers, are alternated between the horizontal/vertical and the diagonal.

In addition to the layer of horizontal woven graphite 72 or diagonal woven graphite 74, each graphite/wood layer 70 has two parallel strips of unidirectional graphite tape 52 and 54 laminated to the top surface of the tree across the pommel 46. The graphite tape strips 52 and 54 are generally placed over the horizontal woven graphite 72 and diagonal woven graphite 74, although the layering could be reversed, with the woven sheet placed over the graphite tape without diminishing the advantages. Whether the tape strips 52 and 54 are placed over or under the horizontal woven graphite 72 and diagonal woven graphite 74, it is beneficial to extend the edge 56 of the horizontal woven graphite 72 and diagonal graphite 74 to approximately the edge of the pommel 46, thereby further reinforcing the weakest point of the saddletree. The width of the strips of graphite tape 52 and 54 must be sufficient to enable the strips, when placed edge to edge, to extend across the entire pommel area. As seen in these figures, the tape 52 can extend across the end of the center cutout 18. The graphite tape 52 should extend to approximately the edge of the saddletree while the graphite tape 54 should extend at least past the bottom of the stirrup bars, or about one inch from the edge of the pommel point 58. Preferably, the unidirectional graphite tape 52 and 54 extend to the edges of the tree, thereby covering between about 95% and 100% of the pommel area. The use of the strips of unidirectional graphite tape across the pommel 46 on each layer, sufficiently stiffens and braces the tree, thereby eliminating the need for the prior art metal gullet plate and top plate.

Figure 3:
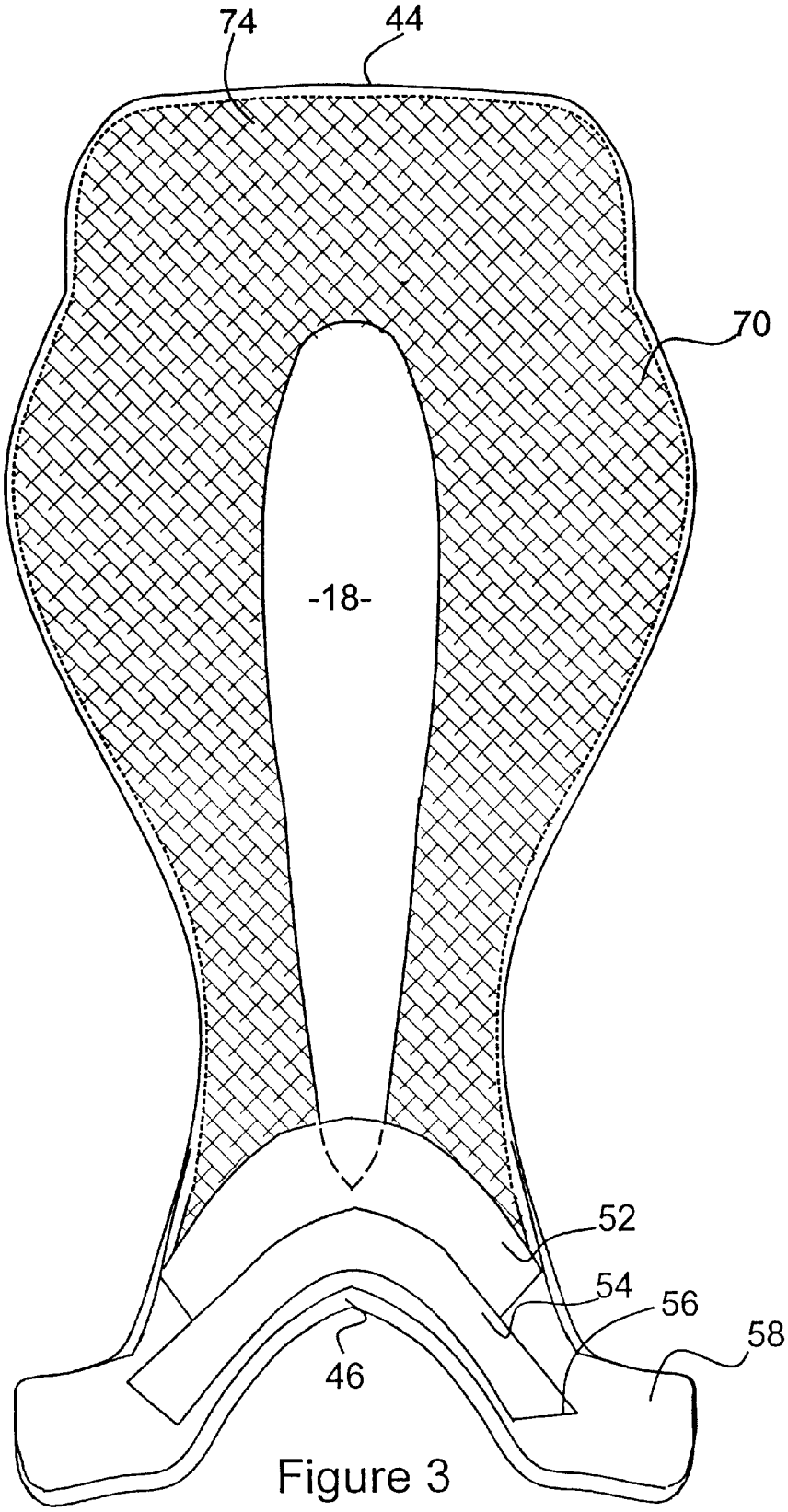
FIG. 3 is a top view of the disclosed saddletree showing interior layers of woven graphite at 45 degree angles to centerline and strips of graphite tape across pommel.

Generally the disclosed saddletree will consist of five (5) layers of wood 70, the interior four (4) layers of wood 70 containing graphite to form wood/woven graphite layers, two at about 90° and two at about 45° from the horizontal, as described in conjunction with FIGS. 2 and 3. The top layer of wood 70 is covered with the graphite tape 52 and 54 as described hereinafter. It should be noted that the specifications set forth herein are to ensure reliability and long-term use for a saddle that is being used professionally. In embodiments where the saddletree is for a lightly used child's saddle, the number of layers as well as the amount and weight of the graphite can be reduce as much as about 40% to 50%.

Figure 4:
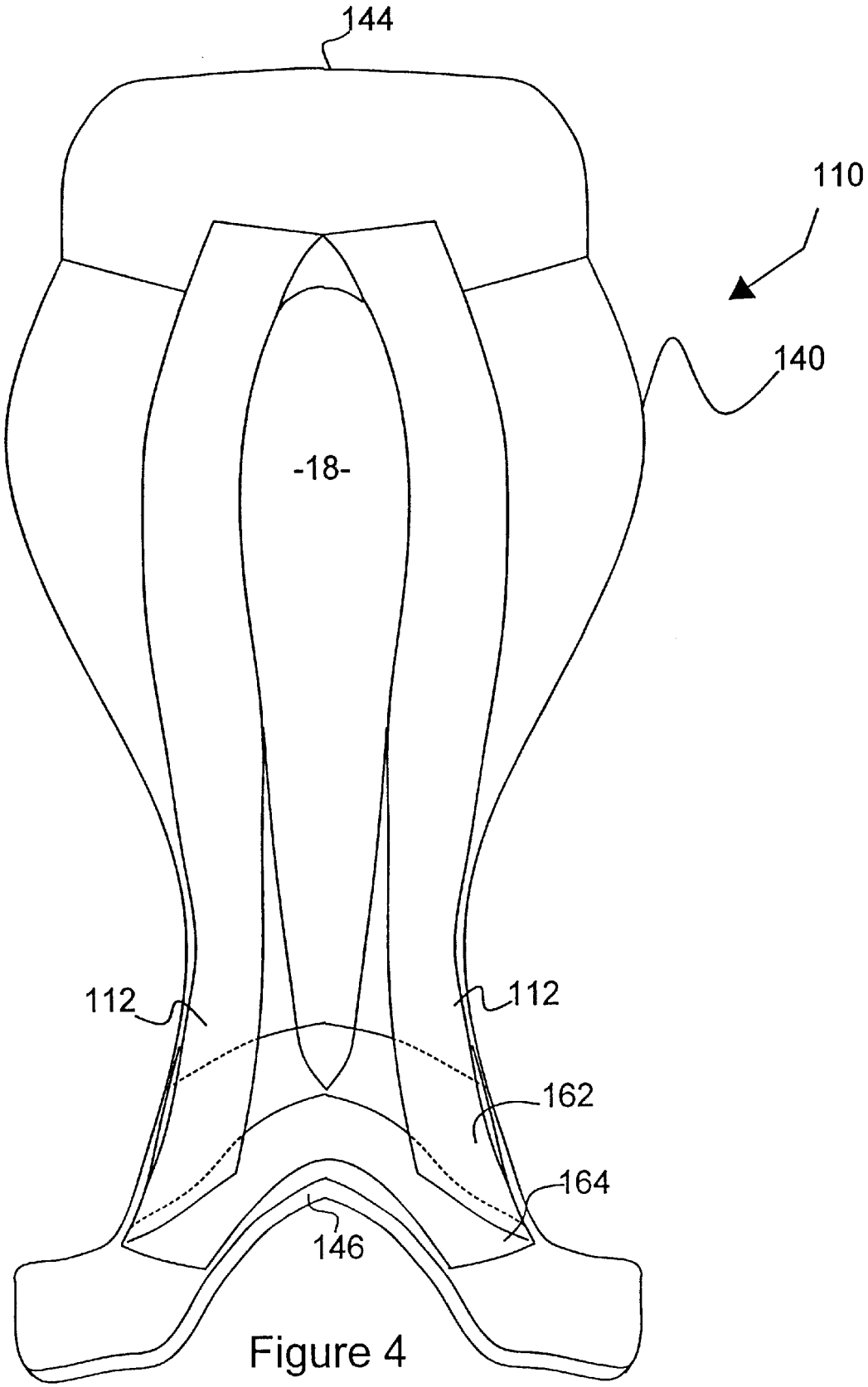
FIG. 4 is a top view of the disclosed saddletree showing the front to back interior strips of graphite tape applied to the laminated saddletree.
Figure 5:
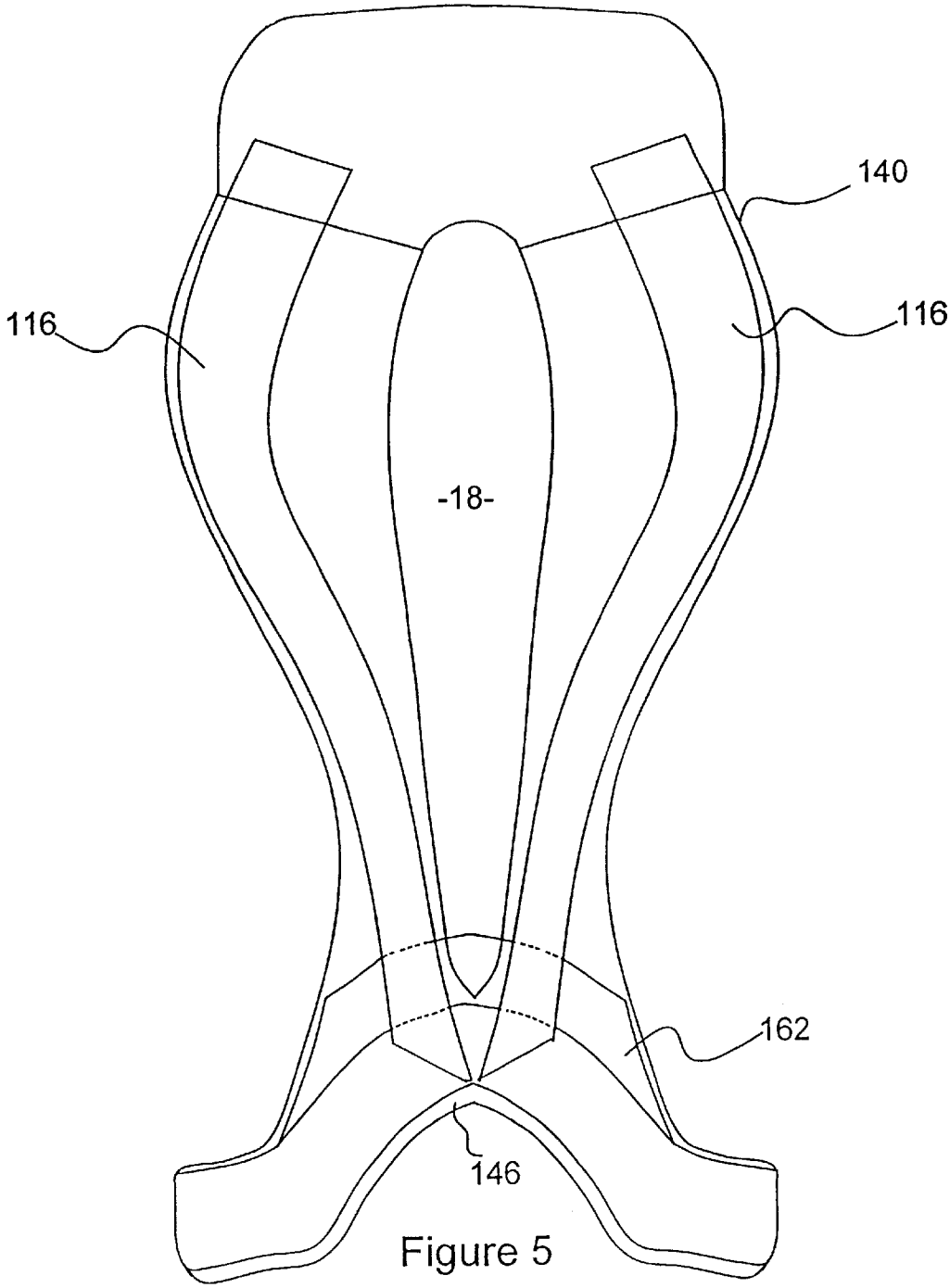
FIG. 5 is a top view of the disclosed saddletree showing the exterior front to back strips of graphite applied to the laminated saddletree.
Figure 6:
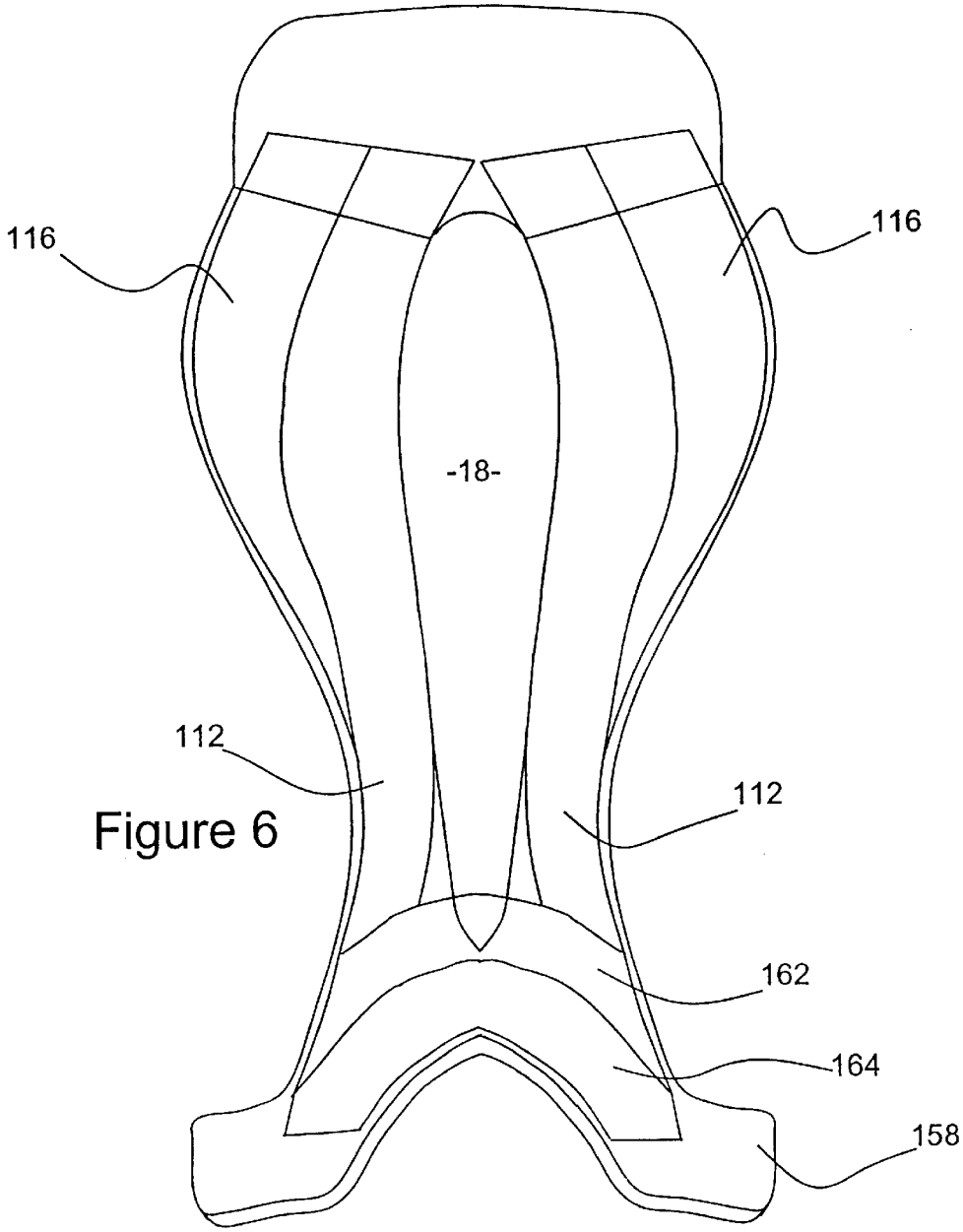
FIG. 6 illustrates a top view of the disclosed saddletree having all four front-to-back graphite strips applied.

Once the layers of wood 70 and alternating layers of horizontal woven graphite 72 and diagonal woven graphite 74 forming the saddletree 110 have been laminated together, graphite tape strips 112 and 116 are placed along the length of the tree, stretching from the cantle 144 to the pommel 146 along the top surface as illustrated in FIGS. 4–6. As can be seen from these figures, the interior strips 112 and exterior strips 116 starts proximate the cantle 144 of the tree 110 and extend toward the pommel 146 at an angle. It is not necessary to extend the strips.

For clarity, the interior strips 112 and exterior strips 116 are shown applied separately in FIGS. 4 and 5. In FIG. 4, the interior strips 112 are shown applied along the length of the body 140 of the saddletree 110 starting adjacent the open center 18 by the cantle 144 and angling toward the outer edge of the tree 110 proximate the pommel 146. In FIG. 5, the exterior strips 116 have been applied and run along the exterior edge of the body 40 approximate the cantle 144, angling inward at the pommel 146. The angling of the graphite strips 112 and 116 provides additional reinforcement against torque by placing the linear strength in the direction of the potential torquing action. Once the interior and exterior strips 112 and 116 have been appropriately secured, a final pair of pommel strips 162 and 164 as seen in FIGS. 5 and 6 are then applied and the secured with the appropriate resin.

In FIG. 6, both the exterior strips 116 and interior strips 112 are illustrated; with the exterior strips 116 have been applied first, with the interior strips 112 being applied over them. It is not the sequence of the layering that is important, but rather the angled placement of the strips as the angle and pattern of placement of the interior and exterior strips, extending from inside to outside in a crisscross manner, braces the saddle against excessive lateral movement. Although this is the preferred pattern, other taping patterns can be used. The cross over pattern of the strips does, however, provide additional reinforcement against the torque and should be, in some manner, maintained. Although not illustrated in the figures herein, the exterior underside of the saddletree 110 is preferably also covered with the interior and exterior strips at described for the upper surface. The use of unidirectional graphite strips along the bottom exterior surface of the saddletree 110 further serves to stiffen the tree and further prevents torquing. The combination of the unidirectional graphite strips with the other graphite layers also braces the saddle against sagging of the mid-section under the rider's weight and stress of rider impact.

It should be noted that the graphite should be spaced from the actual edge of the saddletree a distance sufficient to enable the leather to be stapled, or otherwise secured, to the tree.

The wood/graphite laminate is made in two stages. First the wood is laminated with the graphite layers placed in the interior only. When this has cured, the wood is dressed down, a bevel given to all of the top edges and then sanded. The bevel is important to provide a comfortable transition for the rider from saddle to horse. The top layers are then applied.

The open center 18 of the saddle is smaller than in many prior art saddletrees and should be in the range of about 2 to 3.5 inches in the cantle area for a 17-inch saddle. The change in dimensioning with the increase or decrease saddle size will be evident to those skilled in the art. It should be noted that the open center 18 is narrower by the pommel 46 widening toward the cantle area where it is arced, maintaining the maximum width proximate the cantle. Since the torquing of the tree has been eliminated, as the horse moves the saddle moves side to side, rather than twisting diagonally. With a narrow open area proximate the cantle, as used in the prior art the back of the saddle catches and bumps the horse's spine at each stride. By widening the open area 18 proximate the cantle, the horse is free to move forward without affect to the spine. The underside of the tree is preferably chamfered toward the open area 18 to further prevent any sharp areas that could bump or catch the horse's spine. The open area 18 proximate the pommel 46 is narrower than on prior art saddles in order to increase the surface area of the sidebars 70, enabling the angled placement of the unidirectional graphite strips. To achieve maximum resistance again torque, the strips must be angled as described heretofore.

The disclosed saddletree is manufactured without the addition of any reinforcing metal. The disclosed graphite layered system provides the support previously obtained through the use of metal not only because of the nature of the material but through the ability to eliminate the need for rivets or other affixing devices. In prior art saddletrees rivets were used to attach the metal to the wood, thereby weakening the wood at each point of penetration. Through the use of graphite layers, the wood is not compromised.

The addition of the graphite enabled the removal of the metal required by prior art saddletrees, thereby lightening, however the removal of the gullet also removed the securing system for the under panels. To provide for an attachment mechanism for the under panels, replacing the attachment previously provided by the gullet, the point 158 is routed, as illustrated in FIGS. 7 and 8, to receive the plastic tab 80. The receiving notch 82 is routed into the point 158 approximately ¼ inch and a staple 84 is used to maintain the plastic tab 80 in place. An alternate method of securing the tab 80 is to place tubing over the tab 80 and a portion of the point 158. The tubing is then heated and, in the shrinking process, locks the tab 80 in place. The thickness of the plastic tab 80 is about 1/16th of an inch and it is critical that if either this thickness or depth are increased, that the increase does not compromise the integrity of the wood. The foregoing dimensions are preferred and increasing these dimensions substantially will lessen the strength of the tree. The under panels that are place over the tree are manufactured with a pocket to receive the point 158 and secured plastic tab 80.

In order to provide consistency in the manufacturing process, the stirrup bar receiving holes 90 and 92 are drilled into the saddletree 110 immediately after completion of the molding process, thereby enabling the placement of the receiving holes 90 and 92 to be consistent from saddle to saddle. The stirrup bar receiving holes 90 and 92 also provide a convenient method of aligning the saddletree for routing the receiving notch 82 as well as any other precise measurements. To route the receiving notch 82 a jig has been build with prongs for the receiving holes 90 and 92 and a track to receive the router, thereby maintaining the receiving notch 82 at a consistent depth and centered within the point 158.

Because of the curvature of the saddletree, all the graphite used must have the flexibility to smoothly conform to the tree shape. In tests that were conducted, the torque of the tree presented the greatest problems. It was found that the trees that had only woven graphite in the interior layers did not withstand the pressure applied to the saddle, reinforcing the need to include the graphite tape on the outer layers.

Vacuum forming the graphite to the outer layers of a finished saddletree made with no interior layers of graphite caused distortion in the saddletree shape. Saddletrees formed with only a single layer of graphite tape top and bottom in addition to the interior layers permitted too much torque. In high stress applications, such as would be encountered with professional jumpers or rodeo riders, additional support can be beneficial. To increase the strength of the saddletree, one or two layers of the woven graphite are replaced with the graphite tape in the same pattern as disclosed heretofore. Alternatively, additional layers of graphite tape can be added to the top and/or bottom of the tree, as long as the above noted flexibility remains.

What is claimed is:

1. An equine saddletree having a first surface and a second surface, a cantle, and a pommel, and a pair of side bars extending between said cantle and said pommel forming a length and an open center section along said length, said saddletree having multiple wood layers alternating with graphite layers between each of said wood layer, each of said graphite layers extending from said pommel to proximate said cantle to cover substantially all of a surface of each of said wood layers.

2. The saddletree of claim 1 wherein each of said graphite layers comprises at least one layer of woven graphite sheet material having a warp and fill.

3. The saddletree of claim 2 wherein each of said wood layers further comprise at least one strip of graphite tape, said at least one strip of graphite tape being approximately perpendicular to said side bars and extending across said pommel.

4. The saddletree of claim 2 wherein at least one of said graphite layers has one of said warp or fill approximately parallel to said length forming a parallel layer.

5. The saddletree of claim 4 wherein at least one of said graphite layers has one of said warp or fill at approximately a 45-degree angle to said length forming an angled layer.

6. The saddletree of claim 5 wherein said graphite layers alternate between said parallel layer and said angle layer.

7. The saddletree of claim 1 further comprising at least one pair of graphite tape strips extending diagonally along each of said first surface and said second surface of each of said sidebars.

8. The saddletree of claim 7 wherein a first of said at least one pair of graphite tape strips is adjacent to said center cutout section proximate said cantle at a first end and adjacent an exterior edge proximate said pommel at a second end and a second of said at least one pair of graphite tape strips is adjacent to at an exterior edge proximate said cantle at a first end and adjacent to said center cutout section proximate said pommel at a second end.

9. The saddletree of claim 8 further comprising at least one second layer graphite tape pommel strips, said pommel strips being perpendicular to said length and covering at least a portion of said pommel.

10. The saddletree of claim 1 further comprising a tab, said tab being secured within a notch in opposing ends of said pommel to position cushioning panels having a receiving pocket dimensioned to receive said tab adjacent to said second surface of said saddletree.

11. An equine saddletree having a first surface and a second surface, a cantle, and a pommel, and a pair of side bars extending between said cantle and said pommel forming a length and a center cutout section along said length, said saddletree having:

an exterior wood layer, said exterior wood layer forming said first surface;

multiple interior wood layers, each of said multiple interior wood layers having a first side and a second side;

multiple graphite layers, at least one of said multiple graphite layers being adjacent to said first side of each of said multiple interior wood layers and said second side of an adjacent wood layer, each of said graphite layers comprising:

at least one layer of woven graphite sheet material having a warp and fill, said graphite sheet material extending from said cantle to said pommel to cover substantially all of said first side of each of said multiple interior wood layers, at least one of said multiple graphite layers having one of said warp or fill approximately parallel to said length forming a parallel layer and at least one other of said multiple graphite layers having one of said warp or fill at approximately a 45 degree angle to said length forming an angled layer;

at least one strip of graphite tape, said at least one strip of graphite tape being approximately perpendicular to said side bars and affixed to said first surface of each of said interior wood layers proximate said pommel;

multiple pairs of graphite tape strips extending diagonally along said length of each of said first surface and said second surface, a first of each of said pairs being adjacent to said center cutout section proximate said cantle at a first end and adjacent an exterior edge proximate said pommel at a second end and a second of each of said pairs being adjacent to an exterior edge proximate said cantle at a first end and adjacent to said center cutout section proximate said pommel at a second end;

at least one second layer graphite tape pommel strips on said first surface and said second surface, said pommel strips being perpendicular to said length and covering at least a portion of said pommel, wherein said woven graphite sheet material increases the strength of said saddletree said graphite tape along said pommel prevents said saddletree from spreading and said woven graphite and said graphite tape along said length prevent said saddletree from torque.

12. A method of manufacturing an equine saddletree having a first surface and a second surface, a cantle, and a pommel, and a pair of side bars extending between said cantle and said pommel forming a length and a center cutout section along said length, comprising the steps of:

cutting multiple layers of wood in the shape of said saddletree;

covering a first of said multiple layers of wood with at least one layer of woven graphite sheet material having a warp or fill extending parallel with a centerline extending said length of said saddletree from said cantle to said pommel forming a parallel layer;

placing at least one strip of graphite tape across said pommel approximately perpendicular to said centerline;

covering a second of said multiple layers of wood with at least one layer of woven graphite sheet material having a warp or fill extending at 45 degrees from said centerline, forming an angled layer;

placing at least one strip of graphite tape across said pommel approximately perpendicular to said centerline;

stacking said multiple layers of wood, alternating said second of said multiple layers of wood having an angled layer with said first of said multiple layers of wood having a parallel layer, to a desired thickness;

placing an exterior layer on said stacked multiple layers of wood;

laminating and molding said multiple layers of wood into the shape of a saddle;

placing at least one pair of graphite tape strips diagonally along each of said side bars of each of said first surface and said second surface, a first of each of said at least one pair being adjacent to said center cutout section proximate said cantle at a first end and adjacent an exterior edge proximate said pommel at a second end and a second of said at least one strip of graphite tape is adjacent to at an exterior edge proximate said cantle at a first end and adjacent to said center cutout section proximate said pommel at a second end;

placing at least one second layer graphite tape pommel strips on said first surface and said second surface, said pommel strips being perpendicular to said length and covering at least a portion of said pommel;

routing a notch in each opposing end of said pommel;

placing a pocket receiving tab within said notch and securing said pocket receiving tab within said saddletree;

positioning cushioning panels having a receiving pocket adjacent to said second surface with said pocket receiving tab being placed within said receiving pocket;

securing said cushioning panels to said saddletree;

covering said saddletree with a finishing material.

* * * * *